US005735749A

United States Patent [19]

Charbel et al.

[11] Patent Number: 5,735,749

[45] Date of Patent: Apr. 7, 1998

[54] CARPET POOL GAME

[76] Inventors: Bechara Charbel, 4932 W. 122nd St., Hawthorne, Calif. 90250-3510; Joseph Machaalani, 11336 Twelfth Avenue, Edmonton, Alberta, Canada, T6J6V2

[21] Appl. No.: 746,237

[22] Filed: Nov. 7, 1996

[51] Int. Cl.[6] ..... A63D 15/00

[52] U.S. Cl. ..... 473/3; 473/44; 473/46; 473/412

[58] Field of Search ..... 473/3, 558, 410, 473/411, 412, 44, 46

[56] References Cited

U.S. PATENT DOCUMENTS

| | | | |
|---|---|---|---|
| 278,341 | 5/1883 | Kelly . | |
| 1,150,517 | 8/1915 | Hawks . | |
| 1,593,421 | 4/1926 | Blum . | |
| 1,847,963 | 3/1932 | Hix | 473/410 X |
| 1,856,117 | 3/1932 | Small, Jr. | 473/3 X |
| 1,899,830 | 2/1933 | Small . | |
| 1,899,864 | 12/1933 | Johnson | 473/3 |
| 3,578,321 | 5/1971 | Skully | 273/2 |
| 3,578,325 | 5/1971 | Teas | 273/56 |
| 3,591,176 | 7/1971 | Roth | 273/6 |
| 3,715,123 | 2/1973 | Baum | 473/3 X |
| 3,771,788 | 11/1973 | Hurley et al. | 473/558 X |
| 4,229,004 | 10/1980 | Stokes | 273/3 |
| 4,295,650 | 10/1981 | Keeble | 273/118 R |
| 4,957,288 | 9/1990 | Kantner et al. | 273/2 |
| 5,029,862 | 7/1991 | Driska | 273/119 R |
| 5,417,421 | 5/1995 | Bagley | 273/108 |

FOREIGN PATENT DOCUMENTS

| | | | |
|---|---|---|---|
| 2237209 | 5/1991 | United Kingdom | 273/168 |

*Primary Examiner*—William H. Grieb
*Attorney, Agent, or Firm*—Oppenheimer Poms Smith

[57] ABSTRACT

A carpet pool game and method of playing the same employing three different sets of game balls, mallets and a detachably interconnected assembly of side boards and goal boards including an integrally formed ramp structure preventing game balls from coming to rest too close to the outer boundary of the game.

9 Claims, 2 Drawing Sheets

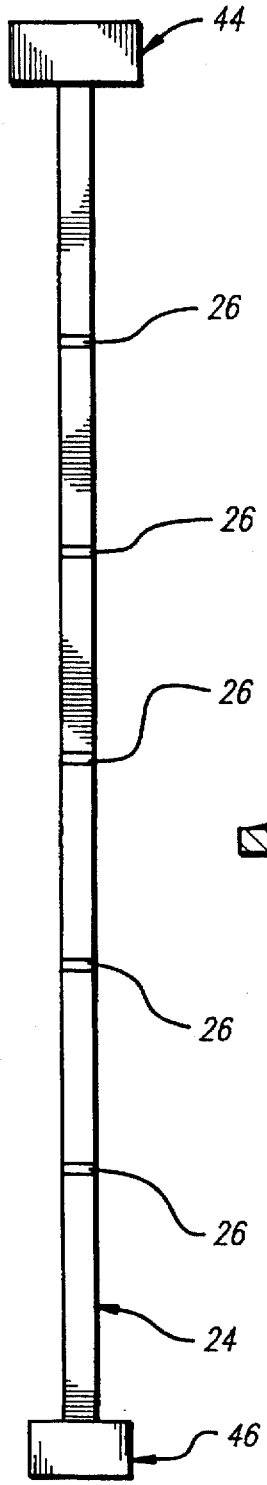
FIG. 3
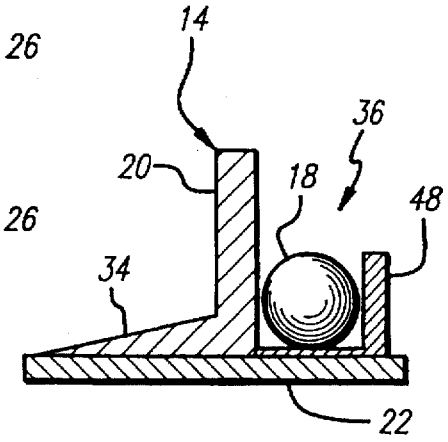
FIG. 4
FIG. 2
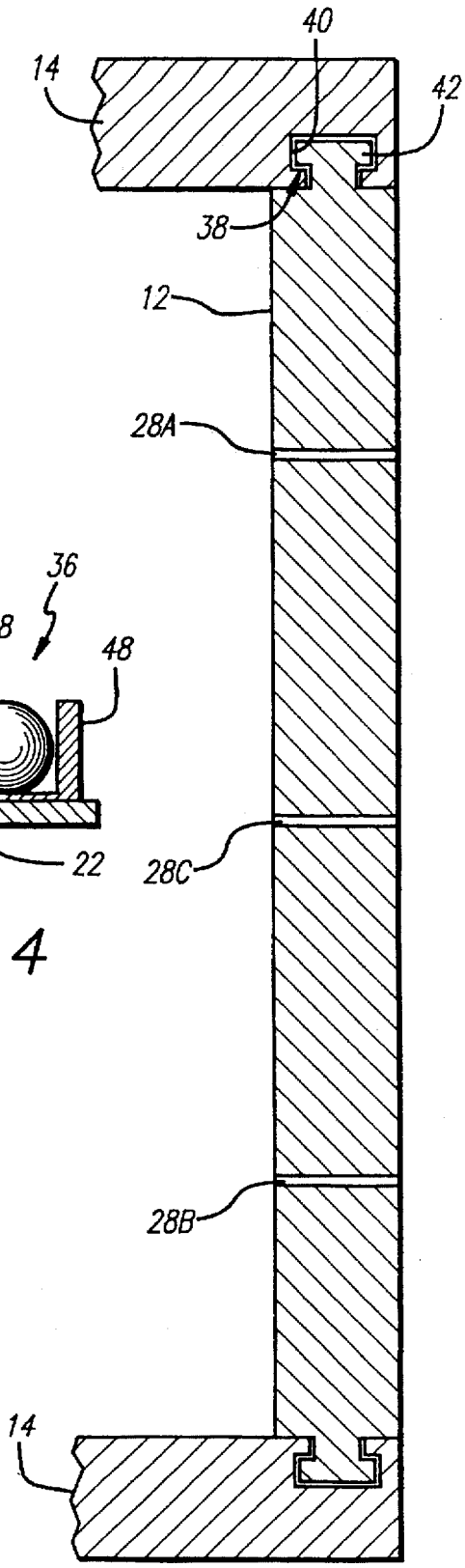

CARPET POOL GAME

BACKGROUND OF THE INVENTION

1. Field of the Invention

The present invention relates to a game apparatus for use on a playing surface such as a carpet and, more particularly, pertains to a carpet pool game including a plurality of walls detachably interconnected to provide an outer boundary of a game field with the walls including ramps inwardly directed from the outer boundary to prevent game balls from coming to rest too close to the outer boundary.

2. Description of the Related Art

A variety of games exist where a game field is defined by a wall or similar structure and where the players seek to propel an object into a receptacle with a striking implement. Examples of such games include ice hockey and billiards. Other games are known (e.g., croquet) where differently marked wooden balls are driven though a series of wickets using long-handled mallets.

Notwithstanding, the art is devoid of a game employing three different sets of game balls, mallets and a detachably interconnected wall assembly with an integrally formed ramp structure designed to prevent game balls from coming to rest too close to the outer boundary of the game. Also, there is a need for an affordable, easily transportable, and readily assembled and disassembled, game apparatus which embodies the aforedescribed features and is suitably designed for use in conjunction with an indoor playing surface such as a carpet.

Accordingly, an object of the present invention is to provide a game apparatus including easily assembled, detachably interconnected wall members which define the outer boundary of the game.

Another object is to provide a game apparatus including an integrally formed ramp structure designed to prevent game balls from coming to rest too close to the outer boundary of the game.

Another object is to provide a game employing three different sets of game balls, mallets and the aforedescribed detachably interconnected wall assembly.

Another object is to provide a game apparatus which embodies these features and which is designed for indoor use with a carpet or similar playing surface.

Yet another object is to provide an affordable, lightweight and durable carpet pool game apparatus which is designed to be quickly and easily assembled and disassembled.

SUMMARY OF THE INVENTION

In accordance with a specific illustrative embodiment of the present invention, a carpet pool game apparatus includes a number of walls with ramps integrally formed thereon, with the walls being detachably interconnected to provide an outer boundary of a game field. Each ramp includes a narrow portion positioned over the game field. Each ramp tapers from the outer boundary to the narrow portion. The walls include two end walls and two side walls, with each of the end walls being formed with an aperture sized sufficiently large to receive a game ball therethrough. The side walls are marked with visible indicia for initially positioning game balls along the game field.

In a further aspect of the present invention, the game apparatus also includes three sets of differently colored game balls and at least one mallet for striking the game balls. The mallet is marked with visible indicia for initially positioning the game balls across the game field.

In another aspect of the present invention, a method for playing a carpet pool game with such a game apparatus is provided. The method includes the steps of: employing the visible indicia of the side walls and the mallet to arrange the game balls in an initial configuration; associating a first player with the first set of game balls and one of the apertures and associating a second player with the second set of game balls and the other aperture; and allowing the players to alternatively take turns until one of the players wins a game round. During the turns, the first player sequentially selects and strikes game balls of the first set with the mallet. The turn of the first player ends when a previously selected game ball of the first set does not pass through the aperture associated with the second player or when the previously selected game ball of the first set comes to rest outside the game field. The first player, after all of the game balls of the first set pass through the aperture associated with the second player, strikes the game ball of the third set, with the first player winning the game round after the game ball of the third set passes through the aperture associated with the second player. If the first player does not win the game round, the second player takes a turn. Similarly, the second player sequentially selects and strikes game balls of the second set with the mallet. The turn of the second player ends when a previously selected game ball of the second set does not pass through the aperture associated with the first player or when the previously selected game ball of the second set comes to rest outside the game field. The second player, after all of the game balls of the second set pass through the aperture associated with the first player, strikes the game ball of the third set, with the second player winning the game round after the game ball of the third set passes through the aperture associated with the first player.

Further aspects of this method also include: allowing the second player to reposition within the game field a game ball which, after being struck by the first player, comes to rest outside the game field and allowing the first player to reposition within the game field a game ball which, after being struck by the second player, comes to rest outside the game field; ending the turn of the first player when a striking motion of the first player imparts a force directly or indirectly resulting in one of the balls of the second set passing through one of the apertures and ending the turn of the second player when a striking motion of the second player imparts a force directly or indirectly resulting in one of the balls of the first set passing through one of the apertures; and awarding the game round to the first player when a striking motion of the second player results in the game ball of the third set passing through one of the apertures before all of the balls of the second set have passed through the first aperture and awarding the game round to the second player when a striking motion of the first player results in the game ball of the third set passing through one of the apertures before all of the balls of the first set have passed through the second aperture.

In a broader aspect of the present invention, the game apparatus includes a plurality of walls with ramps attached thereto, the walls being detachably interconnected to provide an outer boundary of a game field, with each ramp including a narrow portion positioned over the game field and tapering from the outer boundary to the narrow portion.

DESCRIPTION OF THE DRAWINGS

Other objects, features and advantages of the invention will become readily apparent upon reference to the following detailed description when considered in conjunction with the accompanying drawings, in which like reference numerals designate like parts throughout the figures thereof, and wherein:

FIG. 2 is a cross-sectional, partial top view of the carpet pool game of FIG. 1 with the integrally formed ramps being eliminated from the figure for visual clarity;

FIG. 3 is a front view of a game mallet as shown in FIG. 1; and

FIG. 4 is a cross-sectional, side view of an end wall or goal board as shown in FIG. 1.

DETAILED DESCRIPTION OF THE PREFERRED EMBODIMENTS

Figure 1:
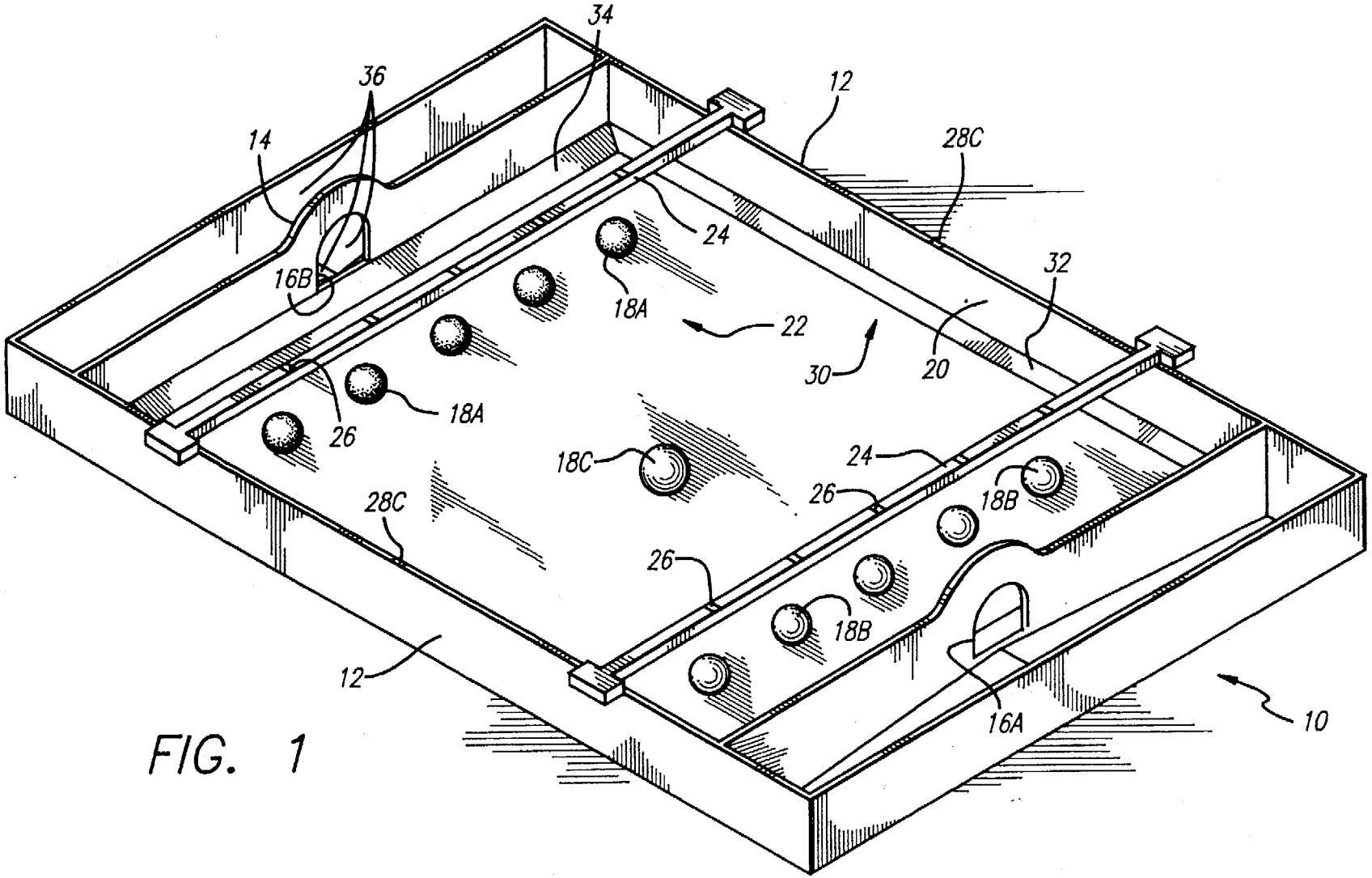
FIG. 1 is perspective view of an exemplary carpet pool game according to the present invention.

FIG. 1 is perspective view of an exemplary carpet pool game 10 according to the present invention. The carpet pool game assembly 10 includes a plurality of detachably interconnected wall members which, in the illustrated preferred embodiment, include two opposing side walls 12 and two opposing end walls 14. At the end of each side wall 12 (which may also be referred to as a side board) one of the end walls 14 (which may also be referred to as a goal board) is detachably interconnected. Similarly, at opposing ends of each end wall 14, the side walls 12 are detachably interconnected so that the game assembly 10 can be easily assembled and disassembled and transported more readily from one location to another.

Each end wall 14 is formed with an aperture 16 sized sufficiently large to receive game balls 18 therethrough. In the illustrated preferred embodiment, the game balls 18 comprise three differently colored sets of game balls: a first set of game balls 18*a;* a second set of game balls 18*b;* and a third set of game balls 18*c*. The game balls 18 are preferably hollow (e.g., 1/16 inch distance between inner and outer diameters) and formed from a lightweight plastic. Although variations are certainly contemplated, the preferred game assembly 10 includes an equal number of game balls of the first and second sets 18*a*, 18*b*, such as five balls of each type, and a third set of game balls 18*c* comprising a single ball.

The side walls 12 and the end walls 14 are interconnected to provide an outer boundary 20 of a game field. Preferably, the walls 12, 14 are interconnected to form a substantially planer game base which makes contact with a playing surface 22. The game apparatus 10 is particularly suited to indoor use where the playing surface 22 comprises a carpet.

The preferred carpet pool game apparatus 10 also includes two mallets 24 which serve multiple purposes. The two mallets 24 are respectively used by a first player and a second player who alternatively take turns striking the game balls 18 according to a set of rules to be discussed below in greater detail. The mallets 24 also include visible indicia 26 which are used to align the game balls 18 across the game field. In other words, the indicia 26 serve as visual cues for setting the balls up in an initial formation at the start of the game. Similarly, the side walls 12 include visible indicia 28 such as colored stripes which serve as a visual cue for aligning the game balls 18 along the game field into an initial formation. As may be readily appreciated, the initial formation, or game ball configuration, may be varied as desired by the players.

As with the game balls 18, the side walls 12 and end walls 14 are preferably formed from a lightweight plastic. A key feature of the present invention is the inclusion of an inwardly directed ramp structure 30 adjoining the outer boundary 20. The ramp structure 30 consists of side ramps 32 and end ramps 34 which, when the walls 12, 14 are interconnected, form a substantially contiguous and inwardly directed ramp structure 30 which prevents the game balls 18 from coming to rest too close to the outer boundary 20 of the game apparatus 10. This allows the players to more easily strike the game balls 18 with the mallets 24 without the walls 12, 14 interfering with the swinging motion.

The end boards 14 also include reservoir portions 36 for receiving the game balls 18 after they pass through the apertures 16. Preferably, the floor of the reservoir 36 is inclined as shown in FIG. 1, or in another suitable manner, such that the game balls 18 will roll further into the reservoir 36 and away from the aperture 16. Like the three sets of game balls 18*a*, 18*b*, 18*c*, which are differently colored, each end wall or goal board 14 may also be differently colored, for example, with the respective colors of two different teams. The end walls 14 may also be decorated with various logos, cartoon characters, etc.

FIG. 2 is a cross-sectional, partial top view of the game assembly 10 with the integrally formed side ramps 32 and end ramps 34 eliminated for visual clarity. The preferred game assembly 10 includes side and end walls 12, 14 formed with an interconnection structure 38. For example, the end walls 14 will be formed with a groove 40 while the side walls 12 will be formed with a tongue member 42 sized to snugly fit within the groove 40 without the need for any glues, adhesives, or the like.

FIG. 2 also shows the visible indicia 28*a*, 28*b*, 28*c* along the side wall 12 in greater detail. The mallets 24 are positioned across the game field over visible indicia 28*a* and 28*b*, respectively. See also, FIG. 1. The indicia 28*a*, 28*b*, 28*c* may, but need not necessarily, comprise stripes colored to correspond to the respective colors of game balls 18*a*, 18*b*, 18*c*.

FIG. 3 shows the game mallet 24 in greater detail. The preferred mallet 24 includes a large striking head 44 and a small striking head 46 on opposing ends thereof. The striking heads 44, 46 are preferably cylindrical in shape. However, the subject matter of the present invention additionally contemplates striking heads 44, 46 with beveled or otherwise modified striking surfaces which, for example, would serve to propel a game ball 18 along an airborne trajectory much like an iron would in the game of golf. Such an alternative head configuration would provide another way for a player to make a "jump shot" besides using the mallet like a pool cue.

FIG. 4 is a cross-sectional, side view of the end wall 14 and shows the reservoir 36 holding a game ball 18. As best seen in this figure, the reservoir 36 also includes a reservoir back wall 48 which stops the game ball 18 after it passes through the aperture 16. Preferably, the end walls 14 are 3 inches high and the end ramp 34 is ½ inch high at its widest point as measured perpendicularly from the playing surface 22. The preferred end ramp 34 extends four inches perpendicularly from the outer boundary 20 toward the center of the game field. The side ramps 32 are preferably the same height and width as the end ramps 34 so that the resulting ramp structure 30 will be substantially contiguous when the walls 12, 14 are interconnected. The preferred dimensions of the outer boundary 20 are 3'×5' which is not so large a game field that a player would need to step over one of the walls 12, 14 to make a shot.

A carpet pool game utilizing the game assembly 10 described above, may be played in a number of different ways. A preferred method of playing a carpet pool game, or set of rules, first involves using the visible indicia 28*a*, 28*b*, 28*c* of the side walls 12 and the visible indicia 26 of the mallets 24 to arrange the game balls 18*a*, 18*b*, 18*c* in an initial configuration. Next, the two players select one of the first and second sets of game balls 18*a*, 18*b* and determine who will take a first turn in any conventional manner such as by flipping a coin. Generally, each player uses one of the mallets 24 to hit one of the sets of game balls 18*a* or 18*b* toward one of the apertures 16. More specifically, the players take alternate turns until one of the players has won a game round. The first player to take a turn sequentially selects and strikes game balls 18*a* of the first set with the mallet 24. The turn of the first player ends when a previously selected game ball 18*a* of the first set does not pass through the aperture 16 associated with the second player or when the previously selected game ball 18*a* of the first set comes to rest outside the game field. After all of the game balls 18*a* of the first set pass through the aperture associated with the second player, the first player strikes the game ball 18*c* of the third set, with the first player winning the game round after the game ball 18*c* of the third set passes through the aperture 16 associated with the second player.

If the first player does not win the game round during the first turn, the second player then takes a turn. As the first player attempted to do, the second player sequentially selects and strikes game balls 18*b* of the second set with the mallet 24. The turn of the second player ends when a previously selected game ball 18*b* of the second set does not pass through the aperture 16 associated with the first player or when the previously selected game ball 18*b* of the second set comes to rest outside the game field. After all of the game balls 18*b* of the second set pass through the aperture 16 associated with the first player, the second player strikes the game ball 18*c* of the third set, with the second player winning the game round after the game ball 18*c* of the third set passes through the aperture 16 associated with the first player.

Although the side walls 12 and end walls 14 are designed to prevent the game balls 18 from coming to rest outside the game field, sometimes a player will strike a game ball 18 in such a manner that an airborne game ball trajectory results. In such a case, the turn of that player comes to an end and the other player is allowed to reposition the game ball 18 which went out of bounds wherever desired. Alternatively, the out-of-bounds game ball 18 could be left out of play for the remainder of the round with the turn of the offending player simply coming to an end.

Exemplary carpet pool game rules also provide that a turn comes to an end when a striking motion of a player imparts a force which directly or indirectly results in one of the game balls 18 associated with the other player passing through one of the apertures 16. Although such a game ball 18 is preferably out of play for the remainder of a round after it enters one of the reservoirs 36, the rules of the game may be modified, if desired, so that the game ball 18 is put back into play in some manner.

The preferred carpet pool rules also provide that the game balls 18 are to be driven through the appropriate aperture 16 in a particular order or sequence. As such, a player is penalized in some manner if the game ball 18*c* of the third set passes through the aperture 16 before all of the game balls of one of the first set 18*a* or second set 18*b*. For example, the game round is awarded to the first player when a striking motion of the second player results in the game ball 18*c* of the third set passing through one of the apertures 16 before all of the game balls 18*b* of the second set have passed through the first aperture 16*a*. Conversely, the game round is awarded to the second player when a striking motion of the first player results in the game ball 18*c* of the third set passing through one of the apertures before all of the game balls 18*a* of the first set have passed through the second aperture 16*b*.

In conclusion, it is to be understood that the foregoing detailed description and the accompanying drawings illustrate the principles of the invention. However, various changes and modifications may be employed without departing from the spirit and scope of the invention. Thus, by way of example and not of limitation, the game assembly 10 may include any number of detachably interlocking walls, apertures, or sets of game balls. Furthermore, the game assembly 10 is not necessarily rectangular in shape. As may be readily appreciated, the rules of the game may need to be modified to accommodate various changes in the structure of the game assembly 10 itself. Accordingly, the present invention is not limited to the specific form shown in the drawings and described in detail hereinabove.

What is claimed is:

1. A game apparatus comprising:

a plurality of walls with ramps integrally formed thereon, the walls being detachably interconnected to provide an outer boundary of a game field, each ramp including a narrow portion positioned over the game field, each ramp tapering from the outer boundary to the narrow portion, the plurality of walls including two end walls and two side walls, each of the end walls being formed with an aperture sized sufficiently large to receive a game ball therethrough, the side walls being marked with visible indicia for initially positioning game balls along the game field;

a plurality of game balls sized to be received through the apertures; and a mallet for striking the game balls, the mallet being marked with visible indicia which, when the mallet is placed in a predetermined position across the game field, provide visual cues for initially positioning the game balls across the game field.

2. A game apparatus comprising:

a plurality of walls with ramps integrally formed thereon, the walls being detachably interconnected to provide an outer boundary of a game field, each ramp including a narrow portion positioned over the game field, each ramp tapering from the outer boundary to the narrow portion, the plurality of walls including two end walls and two side walls, each of the end walls being formed with an aperture sized sufficiently large to receive a game ball therethrough, the side walls being marked with visible indicia for initially positioning game balls along the game field;

a plurality of game balls sized to be received through the apertures, the plurality of game balls including a first and second set of game balls equal in number and a third set of game balls, the first, second and third sets of game balls each being colored differently; and a mallet for striking the game balls, the mallet being marked with visible indicia for initially positioning game balls across the game field.

3. The game apparatus of claim 2 wherein:

the third set of game balls constitutes a single game ball.

4. A method for playing a carpet pool game with the game apparatus of claim 3, the method comprising the steps of:

(a) employing the visible indicia of the side walls and the mallet to arrange the plurality of game balls in an initial configuration;

(b) associating a first player with the first set of game balls and one of the apertures and associating a second player with the second set of game balls and the other aperture; and (c) allowing the players to alternatively take turns until one of the players wins a game round, during the turns, (i) the first player sequentially selects and strikes game balls of the first set with the mallet, the turn of the first player ending when a previously selected game ball of the first set does not pass through the aperture associated with the second player or when the previously selected game ball of the first set comes to rest outside the game field, the first player, after all of the game balls of the first set pass through the aperture associated with the second player, strikes the game ball of the third set, with the first player winning the game round after the game ball of the third set passes through the aperture associated with the second player, and (ii) the second player sequentially selects and strikes game balls of the second set with the mallet, the turn of the second player ending when a previously selected game ball of the second set does not pass through the aperture associated with the first player or when the previously selected game ball of the second set comes to rest outside the game field, the second player, after all of the game balls of the second set pass through the aperture associated with the first player, strikes the game ball of the third set, with the second player winning the game round after the game ball of the third set passes through the aperture associated with the first player.

5. The method for playing a carpet pool game of claim 4 wherein said step (a) further comprises:

positioning the mallet across the game field such that the indicia on the mallet serve as a visual cue for aligning the game balls into the initial formation.

6. The method for playing a carpet pool game of claim 4 wherein said step (c) further comprises:

requiring that each player stand outside the game field when striking the game balls.

7. The method for playing a carpet pool game of claim 4 wherein said step (c) further comprises:

allowing the second player to reposition within the game field a game ball which, after being struck by the first player, comes to rest outside the game field and allowing the first player to reposition within the game field a game ball which, after being struck by the second player, comes to rest outside the game field.

8. The method for playing a carpet pool game of claim 4 wherein said step (c) further comprises:

ending the turn of the first player when a striking motion of the first player imparts a force directly or indirectly resulting in one of the balls of the second set passing through one of the apertures and ending the turn of the second player when a striking motion of the second player imparts a force directly or indirectly resulting in one of the balls of the first set passing through one of the apertures.

9. The method for playing a carpet pool game of claim 4 wherein said step (c) further comprises:

awarding the game round to the first player when a striking motion of the second player results in the game ball of the third set passing through one of the apertures before all of the balls of the second set have passed through the first aperture and awarding the game round to the second player when a striking motion of the first player results in the game ball of the third set passing through one of the apertures before all of the balls of the first set have passed through the second aperture.

* * * * *